US006263953B1

(12) United States Patent
Emil

(10) Patent No.: US 6,263,953 B1
(45) Date of Patent: Jul. 24, 2001

(54) METHOD AND INSTALLATION FOR PRODUCING "LIGHT STEEL" BY CONTINUOUS CASTING WITH GAS INCLUSION

(76) Inventor: Dengler Emil, Kranenbergstrasse 78, D-58452 Witten (DE)

( * ) Notice: Subject to any disclaimer, the term of this patent is extended or adjusted under 35 U.S.C. 154(b) by 0 days.

(21) Appl. No.: 09/462,741

(22) PCT Filed: Jul. 13, 1998

(86) PCT No.: PCT/EP98/04348

§ 371 Date: Jan. 13, 2000

§ 102(e) Date: Jan. 13, 2000

(87) PCT Pub. No.: WO99/04047

PCT Pub. Date: Jan. 28, 1999

(30) Foreign Application Priority Data

Jul. 14, 1997 (DE) ..... 197 30 084

(51) Int. Cl.[7] ..... B22D 11/00; B22D 27/00
(52) U.S. Cl. ..... 164/475; 164/415; 164/79
(58) Field of Search ..... 164/475, 415, 164/79

(56) References Cited

U.S. PATENT DOCUMENTS 3,941,182 3/1976 Bjorksten ..... 164/86
4,898,034 * 2/1990 Kupperman et al. ..... 73/644

FOREIGN PATENT DOCUMENTS 35 16 737 11/1986 (DE) .
0 544 291 6/1993 (EP) .
2194506 3/1974 (FR) .
56-99057 * 8/1981 (JP) ..... 164/475
92 21457 12/1992 (WO) .

OTHER PUBLICATIONS

A.N. Smirnov: "Pulsative Treatment For The Liquid Phase Of Ingots", Metallurgist, vol. 41, No. 3, pp. 22–24, dated Mar. 1977.

* cited by examiner

*Primary Examiner*—Tom Dunn
*Assistant Examiner*—Kevin McHenry
(74) *Attorney, Agent, or Firm*—Banner & Witcoff, Ltd.

(57) ABSTRACT

The problem with continuous casting methods is the production in a single cast of structured material shapes presenting hollow cavities. To this end the invention provides for a continuous casting method comprising the following steps: a) the material is melted and a continuous strand formed from said material; b) the material strand is cooled or left to cool so that at least a part thereof has a temperature at which its structure is pasty; c) gas is introduced into that part of the material strand which has a pasty structure so as to form hollow cavities, the material strand being moved from the top towards the bottom; and d) the material is left to solidify. The invention also relates to a device for carrying out this method.

20 Claims, 2 Drawing Sheets

METHOD AND INSTALLATION FOR PRODUCING "LIGHT STEEL" BY CONTINUOUS CASTING WITH GAS INCLUSION

The invention relates to a continuous casting method for producing material profiles which have cavities, and to a continuous casting apparatus for carrying out such a method.

According to the prior art, various methods of producing porous foamed metal bodies, honeycomb structures comprising steel parts and methods of continuously casting metal strands based on the principle of communicating tubes, including with gas being supplied, are known from the following patent specifications and laid-open patent applications:

German laid-open patent application 38 14 030 A1concerns a foam steel as a structural bracing material. This is produced by adhesively attaching sheets in metal-spheroidal form or provided with depressions on top of one another, which then form a honeycomb structure.

German laid-open patent application 44 16 371 A1discloses a method of producing long, porous foamed metal bodies on an aluminum basis. These foamed metal bodies, inserted in aluminum hollow profiles, increase the section modulus of the latter with respect to bending and twisting. The foamed metal bodies are foamed from metal powder and blowing agent, this mixture being heated to at least the melting temperature of the metal to form a porous metal body.

The disadvantage of the prior art from DE 38 14 030 A1 and DE 44 16 371 A1 is that, although the methods described there allows [sic] the production of components from a plurality of prepared parts with cavities formed as pores, production of material profiles with cavities in a single cast is not possible.

In WO 86/06431 and WO 88/04586 there are described methods which, although they allow good shaping for obtaining cavities in material profiles, are not particularly suitable for a lightweight construction of load-bearing components. In WO 88/04586 there are described a method and an apparatus for continuously casting metal strands from high-melting metals with cross sections close to the final dimensions, based on the principle of communicating tubes.

German laid-open patent application 35 16 737 A1 discloses a method and an apparatus for producing metallic materials interspersed with gas bubbles as cavities in the form of profiles, which have in relation to their own weight a higher section modulus with respect to bending, buckling and twisting stresses.

The method described there has the disadvantage that the gas bubbles introduced cannot be positioned, since they are introduced into an upwardly directed material strand in the still liquid state and consequently, owing to their buoyancy, initially move in the melt until the latter solidifies. Furthermore, in this method only a relatively small reduction in the relative density of the starting material is possible.

The invention is based on the object of providing a continuous casting method for producing material profiles, in particular steel profiles, which have cavities, and a continuous casting apparatus for carrying out such a method, the material weight of the profiles being reduced by introducing gas bubbles, which can preferably be arranged flexibly in their position and extent and which form cavities.

This object is achieved by a continuous casting method for producing material profiles which have cavities, comprising the steps of:

a) melting the material and forming a strand from the material;

b) cooling or leaving to cool the material strand, so that at least part of the material strand is at a temperature at which there is a pasty structure;

c) introducing gas into that part of the material strand which has a pasty structure so as to form cavities, the material strand being directed downwards from above; and d) leaving the material to solidify.

With this method, cavities can be positioned as desired in material profiles, since the gas bubbles are introduced into such regions of the material strand where there is a pasty structure of the material. A pasty structure is understood to mean a state of the material between liquid melt and solidification in which gas bubbles—if appropriate under high pressure—can still be introduced into the material by means of nozzles or the like. Therefore, independent motion of the gas bubbles in the material strand is possible only to an extremely restricted extent—if at all—and should be eliminated entirely if a specific position and structure of the cavities are desired.

Moreover, directing the material strand downwards from above, counter to the direction of uplift of the gas bubbles in the material strand, achieves the effect that the gas bubbles are to the greatest extent unable to leave the pasty region of the material strand in the direction of the liquid region, but instead form a cavity filled with the gas, as intended.

Metallic materials are preferably used as the material.

In step c), the gas is preferably introduced at a plurality of points lying on an isothermal surface within the material strand. In this way, a plurality of cavities can be produced simultaneously by inclusion of gas bubbles.

In step c), an inert gas, for example argon, is preferably used, to avoid undesired chemical reactions taking place between the material and the gas, which can result in an alteration in the material structure in the solidified state.

In step c), the gas may be supplied continuously or in a pulsed manner. Consequently, with continuous movement of the material strand along the mould, both elongated, continuous cavities and cavities arranged one behind the other in the longitudinal direction of the material strand can form.

The structure of the cavities produced can be monitored by at least one ultrasonic measuring device, which is arranged in the region of the running-off material strand.

The outer skin of the material strand is preferably reinforced by fibers.

In step c), the speed of the material strand is preferably greater than the rate of uplift of bubbles formed from the gas. In this case, the gas bubbles introduced cannot escape upwards, in the direction of the liquid material region. On account of the pasty structure of that part of the material into which the gas bubbles are introduced, the rate of uplift is, however, negligible under normal circumstances. On account of its dependence on the size of the cavities, it may, however, be of a certain significance in individual cases when there are very large cavities.

The invention also relates to a continuous casting apparatus for producing material profiles which have cavities, with a reservoir for liquid material which has a closable outlet opening at the bottom; and a chilled mould for cooling liquid material leaving the outlet opening as a strand, the mould being arranged beneath the outlet opening and essentially vertically;

at least one gas tube being provided for introducing gas, and the gas tube having an outlet opening which, dependent on the material used, is arranged in the interior of the mould in a region in which the material strand has a pasty structure on account of the cooling by the mould.

This apparatus ensures both that the material strand is directed downwards from above and that the gas bubbles are introduced in that region in the interior of the mould in which there is material with the suitable, pasty structure.

A control device, for example a controllable valve block, is preferably provided, with which the introduction of gas into the material strand can be controlled in its amount, which depends on the gas pressure used, and/or its form, continuously or in a pulsed manner.

The supply of gas can take place via nozzles which are arranged at the outlet end of the gas tubes and the openings of which may have, for example, a round, slit-shaped or rectangular cross section, depending on the desired cross-sectional shape for the cavities. In particular in the case of a rectangular cross section, bridges may be provided in the nozzle openings to secure the core of the material strand.

At least one ultrasonic measuring device is preferably provided for monitoring the structure of the cavities of the material strand running off.

Electric signals of the ultrasonic measuring device which reproduce the structure of the cavities can be fed to the control device, so that, dependent on the measuring results of the ultrasonic measuring device, the desired structure of the cavities can be produced. For example, larger cavities can be formed by increasing the gas pressure in the cross section of the material strand or more extended cavities can be formed by lengthening the gas pulse duration in the direction of the strand.

The method and an apparatus adapted to the material to be processed can be used for producing profiles from light-weight metal, non-ferrous metal or plastic, the method and apparatus being designed according to the requirements of the materials to be processed.

BRIEF DESCRIPTION OF THE DRAWINGS

The invention is explained in more detail below on the basis of preferred embodiments with reference to the drawings, in which:

FIG. 1 shows an embodiment of a continuous casting apparatus, which is partly represented in section. The position of a supply line 1 from a transporting tank is denoted by an arrow. A reservoir 2 is filled, for example with liquid steel which is kept at temperature by a heating device. At the bottom of the reservoir 2 there is a closable outlet opening, designed as a funnel, which can be opened and closed by a regulated valve 3, a level control being provided by means of an ultrasonic sensor 17.

Figure 1:
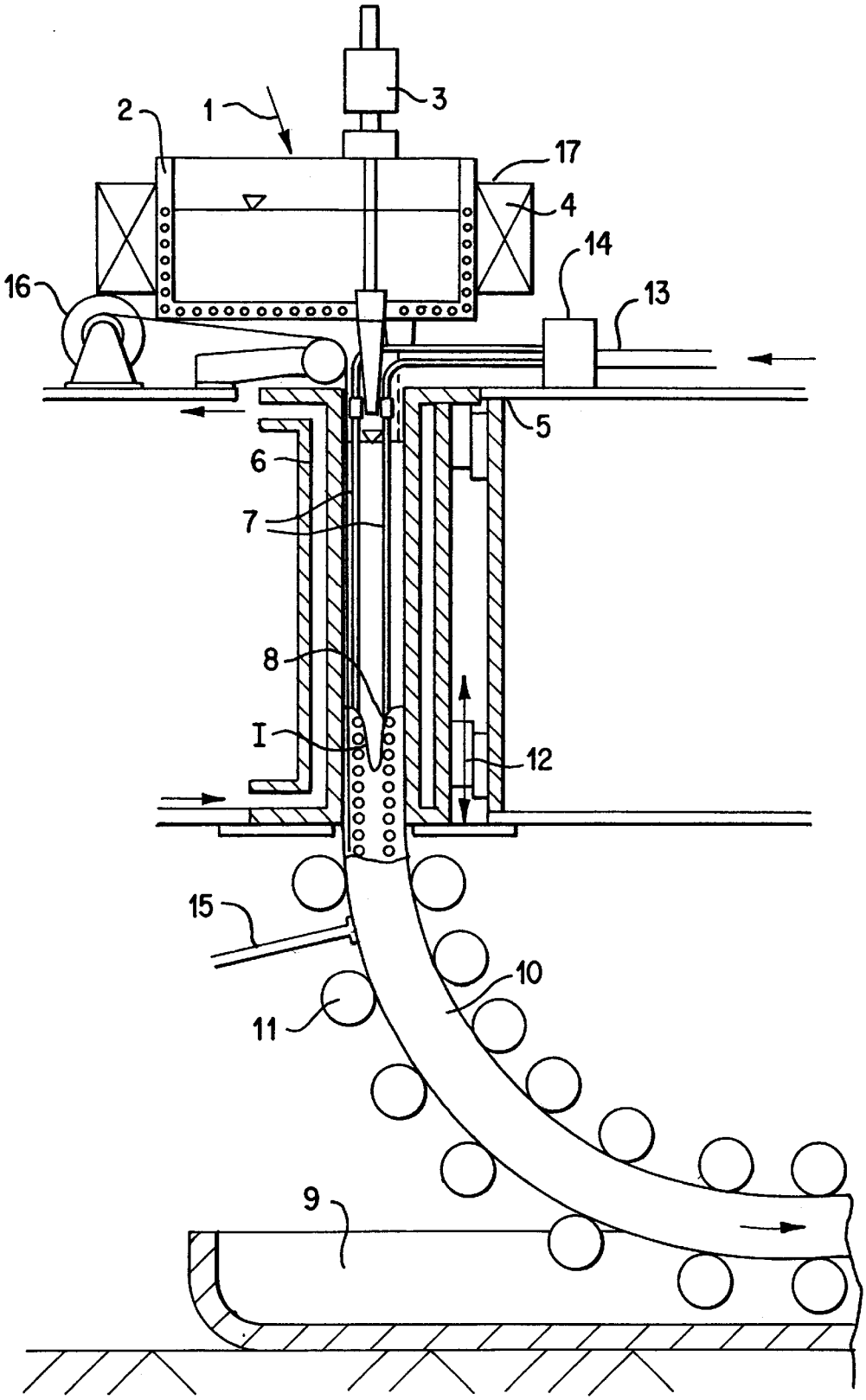
FIG. 1 shows a view of an embodiment of a continuous casting apparatus, partially in section.
Figure 2A:
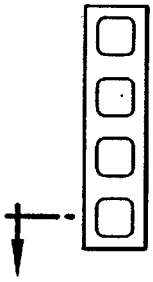
FIGS. 2A and 2B show a cross-sectional view and a longitudinal-sectional view of a plate-shaped material profile.
Figure 3A:
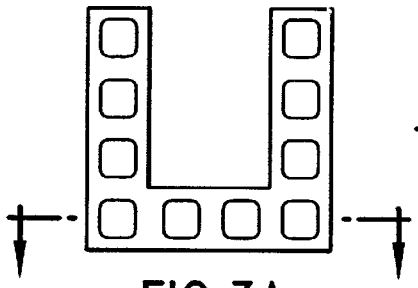
FIGS. 3A and 3B show a cross-sectional view and a longitudinal-sectional view of a U-shaped material profile.
Figure 4A:
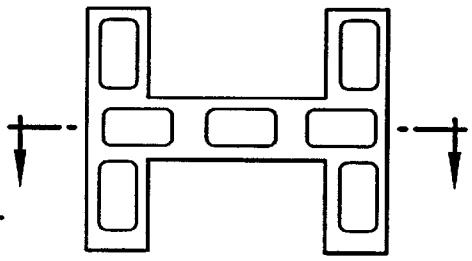
FIGS. 4A and 4B show a cross-sectional view and a longitudinal-sectional view of a T-shaped material profile.
Figure 2B:
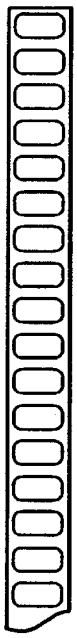
Figure 3B:
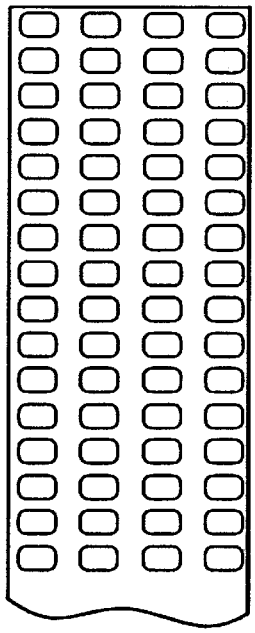
Figure 4B:
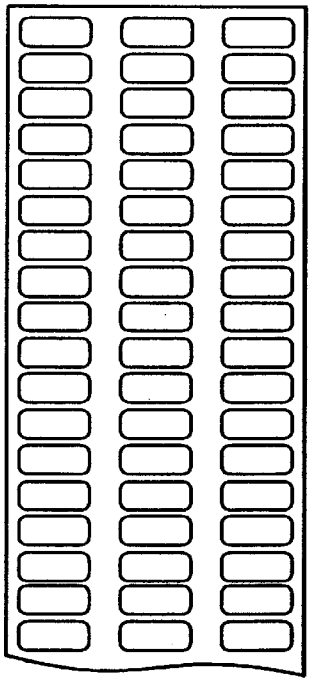

The reservoir 2 is surrounded by an electromagnetic agitating mechanism 4, so that the liquid steel can be degassed and homogenized. The melt is let out into a mould 6 which is arranged vertically beneath the outlet opening of the reservoir 2 and is liquid-cooled. The mould 6 is fastened in vertically arranged slide elements on the platform 5.

If steel is used as the material, its melt can enter the mould region for example at approximately 1400° C. and, after cooling by the mould 6, reach a temperature of approximately 800° C., at which the melt becomes pasty. Independently of the temperatures mentioned, what is most important, however, as will be explained later, is the region of the melt in which the latter exhibits a pasty structure.

Tubes 7 made of a material resistant to high temperatures, for example ceramic, which are connected to a valve block 14, are immersed in the melt. In addition to the supply of gas 13, if required, a cooling device is provided. The gas is an inert gas, for example argon, which does not react with the steel. The gas is pressure-regulated and may be controlled by means of the valve block 14 in such a way that each individual tube 7 can be opened and closed in a timed manner and, if required, different pressures can be set.

The gas pressure must be constantly controlled and regulated in such a way that no steel can be forced back into the gas lines. The supply of gas takes place via openings of the tubes 7 in a region in which the melt is in a pasty state, preferably along or close to a region of the same temperature, as identified in FIG. 1 by an isothermal line I.

As a result, the gas bubbles 8 forming can be exactly positioned and controlled in their extent, so that cavities are produced in the material strand in a predeterminable manner.

The mould 6 is designed and directed by means of a vertical guide 12 in such a way that a vertical oscillation at a frequency of approximately 1 Hz is possible, in order to prevent caking of the melt on the mould wall and on the gas tubes 7 and to allow the gas bubbles 8 introduced to be better separated from one another.

A built-on, further ultrasonic measuring device makes it possible to assess the bubble structure, it being possible for a water-cooled graphite mass to serve as the transmission medium. It is advantageous to arrange approximately 2 measuring devices at an angle of 90° with respect to each other, to allow a spatial assessment of the bubble structure produced. The electric output signal of the ultrasonic measuring device 15 may be used for controlling the valve block 14, for example the gas pressure set there and the gas pulse duration used there, in order to produce the desired bubble and cavity structure.

As an option, an X-ray device may be additionally used to obtain information on the bubble structure.

The gas bubbles 8 can, according to the position of the gas tubes 7, be positioned and controlled in their vertical and horizontal extent and distribution on the cross section. The latter can be accomplished, for example, by means of the shape of the openings of the gas tubes 7 in combination with a corresponding gas pressure control.

The falling and still externally cooled strand is taken over beneath the mould 6 by a transporting device 11, which may be regulated in its speed in such a way that optimum process control is possible. This means, inter alia, that, for example, the speed of the strand is greater than the rate of uplift of the gas bubbles 8 introduced, if such an independent movement is possible at all in the pasty structure of the material.

When the strand 10 has reached the horizontal plane, it can be divided, and the detached portions can be passed on for further processing. Beneath the installation there is the catching tray 9 for any liquid material escaping.

The possible cross-sectional shapes of the material profiles produced range from a plate-like structure, rectangular shape or U-shape to the double-T beam structure, etc. In addition, it is possible to introduce a fiber reinforcement, preferably in the outer skin of the material profile, to increase significantly the section moduli with respect to bending, buckling and twisting, the fibers being uncoiled from a fiber reinforcement device 16 in the form of rollers, which are distributed correspondingly around the periphery. A pretensioning of the fibers in certain regions, which appears to be expedient from the way in which the material profile is to be used, is likewise possible.

FIGS. 2A, 2B, 3A, 3B, 4A and 4B show the cross-sectional shapes, as described above, with the associated longitudinal sections, the shape of the gas bubbles being variable however.

The entire apparatus is regulated by a process control system in such a way that continuous production is possible.

What is claimed is:

1. Continuous casting method for producing material profiles which have cavities, comprising the steps of:

a) melting the material and forming a strand from the material;

b) cooling or leaving to cool the material strand, so that at least part of the material strand is at a temperature at which there is a pasty structure;

c) introducing gas into that part of the material strand which has a pasty structure so as to form cavities, the material strand being directed downwards from above; and d) leaving the material to solidify.

2. Method according to claim 1, in which metallic materials are used as the material.

3. Method according to claim 1, in which, in step c), the gas is introduced at one or more points within the material strand.

4. Method according to claim 3, in which, when the gas is introduced in step c) at a plurality of points within the material strand, these lie close to or on an isothermal surface.

5. Method according to claim 1, in which, in step c), an inert gas is used as the gas.

6. Method according to claim 1, in which, in step c), the gas is supplied continuously or in a pulsed manner.

7. Method according to claim 1, in which the structure of the cavities produced is monitored by at least one ultrasonic measuring device.

8. Method according to claim 1, in which an outer skin of the material strand is reinforced by fibers.

9. Continuous casting apparatus for producing material profiles which have cavities, said apparatus comprising:

a reservoir for liquid material which has a closeable outlet at the bottom;

a chilled mould for cooling liquid material leaving the outlet opening as a strand, the mould is arranged beneath the outlet opening and essentially vertically; and at least one gas tube is provided for introducing gas, the gas tube has an outlet opening which is arranged in the interior of the mould in a region in which the material strand has a pasty structure on account of the cooling by the mould.

10. Apparatus according to claim 9, a control device is provided, with which the introduction of gas into the material strand can be controlled in its amount and/or its form, continuously or in a pulsed manner.

11. Apparatus according to claim 10, wherein at least one ultrasonic measuring device is provided for monitoring the structure of the cavities of the material strand exiting said mould.

12. Apparatus according to claim 11, signals of the ultrasonic measuring device which reproduce the structure of the cavities are fed to the control device.

13. Apparatus according to claim 9, wherein at least one ultrasonic measuring device is provided for monitoring the structure of the cavities of the material strand exiting said mould.

14. Apparatus according to claim 13, wherein signals of the ultrasonic measuring device which reproduce the structure of the cavities are fed to a control device.

15. Method according to claim 2, in which, in step c), the gas is introduced at one or more points within the material strand.

16. Method according to claim 15, in which, when the gas is introduced in step c) at a plurality of points within the material strand, these lie close to or on an isothermal surface.

17. Method according to claim 5 wherein said inert gas includes argon.

18. Method according to claim 5, in which, in step c), the gas is supplied continuously or in a pulsed manner.

19. Method according to claim 2, in which the structure of the cavities produced is monitored by at least one ultrasonic measuring device.

20. Method according to claim 19, in which the outer skin of the material strand is reinforced by fibers.

* * * * *